US009835058B2

(12) United States Patent
Son et al.

(10) Patent No.: US 9,835,058 B2
(45) **Date of Patent: *Dec. 5, 2017**

(54) CONTINUOUS VARIABLE VALVE LIFT APPARATUS AND ENGINE PROVIDED WITH THE SAME

(71) Applicant: HYUNDAI MOTOR COMPANY, Seoul (KR)

(72) Inventors: You Sang Son, Suwon-si (KR); Kyoung Pyo Ha, Seongnam-si (KR); Back Sik Kim, Osan-si (KR); Kiyoung Kwon, Yongin-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 107 days.

This patent is subject to a terminal disclaimer.

(21) Appl. No.: 14/952,408

(22) Filed: Nov. 25, 2015

(65) Prior Publication Data

US 2016/0369661 A1 Dec. 22, 2016

(30) Foreign Application Priority Data

Jun. 22, 2015 (KR) ..... 10-2015-0088630

(51) Int. Cl.

| | |
|---|---|
| ***F01L 1/18*** | (2006.01) |
| ***F01L 13/00*** | (2006.01) |
| ***F01L 1/053*** | (2006.01) |
| *F01L 1/24* | (2006.01) |
| *F01L 1/26* | (2006.01) |
| *F01L 1/047* | (2006.01) |

(52) U.S. Cl.

CPC ..... *F01L 13/0026* (2013.01); *F01L 1/053* (2013.01); *F01L 1/185* (2013.01); *F01L 1/2405* (2013.01); *F01L 1/267* (2013.01); *F01L 2001/0473* (2013.01); *F01L 2001/0476* (2013.01); *F01L 2013/0068* (2013.01); *F01L 2013/103* (2013.01); *F01L 2105/00* (2013.01)

(58) Field of Classification Search

CPC . F01L 1/185; F01L 1/053; F01L 1/267; F01L 1/2405; F01L 13/0026; F01L 2001/0473

USPC ..... 123/90.16, 90.39, 90.44, 90.27, 90.31, 123/90.6

See application file for complete search history.

(56) References Cited

U.S. PATENT DOCUMENTS 7,669,564 B2 * 3/2010 Tochiki ..... F01L 13/0063 123/90.16

FOREIGN PATENT DOCUMENTS

| | | |
|---|---|---|
| JP | 5582195 | 7/2014 |
| KR | 10-1998-0071049 A | 10/1998 |
| KR | 10-2010-0047673 A | 5/2010 |

* cited by examiner

*Primary Examiner* — Ching Chang
(74) *Attorney, Agent, or Firm* — Brinks Gilson & Lione

(57) ABSTRACT

A continuously variable valve lift apparatus may include a camshaft, a cam portion on which a cam is formed and to which the camshaft is inserted, a slider housing to which the cam portion is rotatably inserted and is movable with respect to the camshaft, a control portion selectively changing the position of the slider housing, an output portion rotatable around a pivot shaft and to which a valve shoe is formed. The valve shoe drives a valve unit.

16 Claims, 11 Drawing Sheets

CONTINUOUS VARIABLE VALVE LIFT APPARATUS AND ENGINE PROVIDED WITH THE SAME

CROSS-REFERENCE TO RELATED APPLICATION

This application claims the benefit of Korean Patent Application No. 10-2015-0088630, filed on Jun. 22, 2015, which is incorporated herein by reference in its entirety.

FIELD

The present disclosure relates to a continuous variable valve lift apparatus and an engine provided with the same.

BACKGROUND

The statements in this section merely provide background information related to the present disclosure and may not constitute prior art.

An internal combustion engine generates power by burning fuel in a combustion chamber in an air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

Desired operation of the intake valves and the exhaust valves depends on a rotation speed of the engine. That is, an optimal lift or optimal opening/closing timing of the valves depends on the rotation speed of the engine. In order to achieve such desired valve operation depending on the rotation speed of the engine, various researches, such as designing of a plurality of cams and a continuous variable valve lift (CVVL) that can change valve lift according to engine speed, have been undertaken.

Also, in order to achieve such a desired valve operation depending on the rotation speed of the engine, research has been undertaken on a continuously variable valve timing (CVVT) apparatus that enables different valve timing operations depending on the engine speed. The general CVVT may change valve timing with a fixed valve opening duration.

However, the general CVVL and CVVT are complicated in construction and are expensive in manufacturing cost.

The above information disclosed in this Background section is only for enhancement of understanding of the present disclosure and it may contain information that is not already known to a person of ordinary skill in the art.

SUMMARY

The present disclosure provides a continuous variable valve lift apparatus, and an engine provided with the apparatus may vary valve lift according to operation conditions of an engine, with a simple construction.

A continuously variable valve lift apparatus according to an embodiment of the present disclosure may include a camshaft, a cam portion of which a cam is formed thereto and the camshaft is inserted into therein, a slider housing of which the cam portion is rotatably inserted therein and of which a position with respect to the camshaft is movable, a control portion selectively changing the position of the slider housing, an output portion rotatable around a pivot shaft and of which a valve shoe is formed thereto and a valve unit configured to be driven by the valve shoe.

The continuously variable valve lift apparatus may further include a connecting pin connected with the camshaft and a spiral bearing mounted to the cam portion and of which the connecting pin is inserted therein.

The continuously variable valve lift apparatus may further include a bearing interposed between the cam portion and the slider housing.

The output portion may include an output roller contacting the cam.

A ball screw housing may be formed to the slider housing, and wherein the control portion may include a ball screw engaged with the ball screw housing and a control motor driving the ball screw.

The valve unit may include a swing arm roller contacting the valve shoe and a valve.

A rail may be formed to the slider housing for guiding movement of the slider housing.

The cam may be formed to both side of the cam portion the output portion may be configured as a pair to contact to each cam and the valve unit may be configured as a pair and each valve unit includes a swing arm roller contacting to each valve shoe of each output portion and a valve.

An engine according to an embodiment of the present disclosure may include a camshaft, a cam portion of which a cam is formed thereto and the camshaft is inserted into therein, a slider housing of which the cam portion is rotatably inserted therein and of which a position with respect to the camshaft is movable on a cylinder head, a control portion selectively changing the position of the slider housing, an output portion rotatable around a pivot shaft connected to the cylinder head and of which a valve shoe is formed thereto and a valve unit configured to be driven by the valve shoe.

The engine may further include a connecting pin connected with the camshaft and a spiral bearing mounted to the cam portion and of which the connecting pin is inserted therein.

The engine may further include a bearing interposed between the cam portion and the slider housing.

The output portion may include an output roller contacting the cam.

A ball screw housing may be formed to the slider housing, and wherein the control portion may include a ball screw engaged with the ball screw housing and a control motor driving the ball screw.

The valve unit may include a swing arm roller contacting the valve shoe and a valve.

A rail may be formed to the slider housing for guiding movement of the slider housing.

The cam may be formed to both side of the cam portion, the output portion may be configured as a pair to contact to each cam and the valve unit may be configured as a pair and each valve unit include a swing arm roller contacting to each valve shoe of each output portion and a valve.

As described above, a continuous variable valve lift apparatus according to an embodiment of the present disclosure may vary valve lift according to operation conditions of an engine, with a simple construction.

The continuous variable valve lift apparatus according to an embodiment of the present disclosure may reduce duration in minimum valve lift comparing to general continuous variable valve lift apparatuses.

The continuous variable valve lift apparatus according to an embodiment of the present disclosure may advance closing timing of an intake valve so that may reduce pumping loss and enhance fuel economy.

The continuous variable valve lift apparatus according to an embodiment of the present disclosure may be reduced in size and thus the entire height of a valve train may be reduced.

Since the continuous variable valve lift apparatus may be applied to an existing engine without excessive modification, thus productivity may be enhance and production cost may be reduced.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
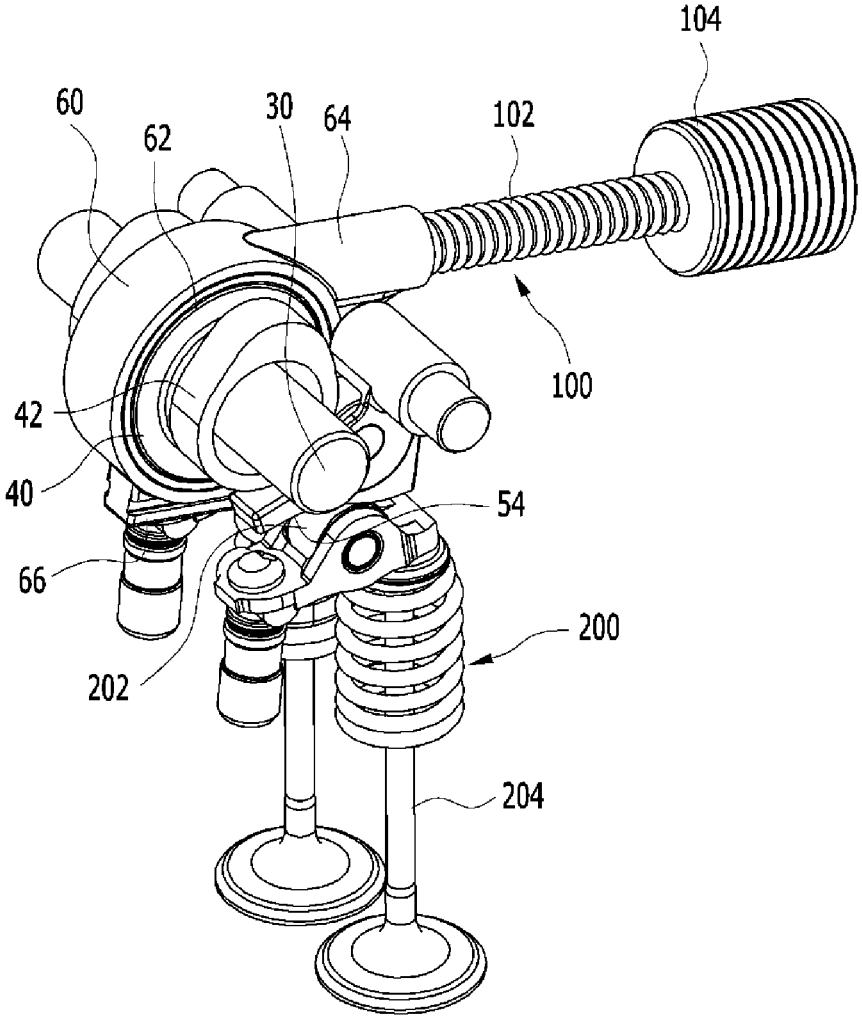
FIG. 1 is a perspective view of a continuous variable valve lift apparatus.

The drawings described herein are for illustration purposes only and are not intended to limit the scope of the present disclosure in any way.

| <Description of symbols> | |
|---|---|
| 1: engine | 10: cylinder head |
| 30: camshaft | 32: connecting pin |
| 40: cam portion | 42: cam |
| 44: driving surface | 46: driving hole |
| 50: output portion | 52: pivot shaft |
| 54: valve shoe | 56: output roller |
| 60: slider housing | 62: bearing |
| 64: ball screw housing | 66: rail |
| 80: spiral bearing | 82: inner wheel |
| 84: outer wheel | 100: control portion |
| 102; ball screw | 104: control motor |
| 200: valve unit | 202: swing arm roller |
| 204: valve | |

DETAILED DESCRIPTION

The following description is merely exemplary in nature and is not intended to limit the present disclosure, application, or uses. It should be understood that throughout the drawings, corresponding reference numerals indicate like or corresponding parts and features.

As those skilled in the art would realize, the described embodiments may be modified in various different ways, all without departing from the spirit or scope of the present disclosure A part irrelevant to the description will be omitted to clearly describe the present disclosure, and the same or similar elements will be designated by the same reference numerals throughout the specification.

In the drawings, the thickness of layers, films, panels, regions, etc., are exaggerated for clarity.

Throughout the specification and the claims, unless explicitly described to the contrary, the word "comprise" and variations such as "comprises" or "comprising", will be understood to imply the inclusion of stated elements but not the exclusion of any other elements.

Figure 2:
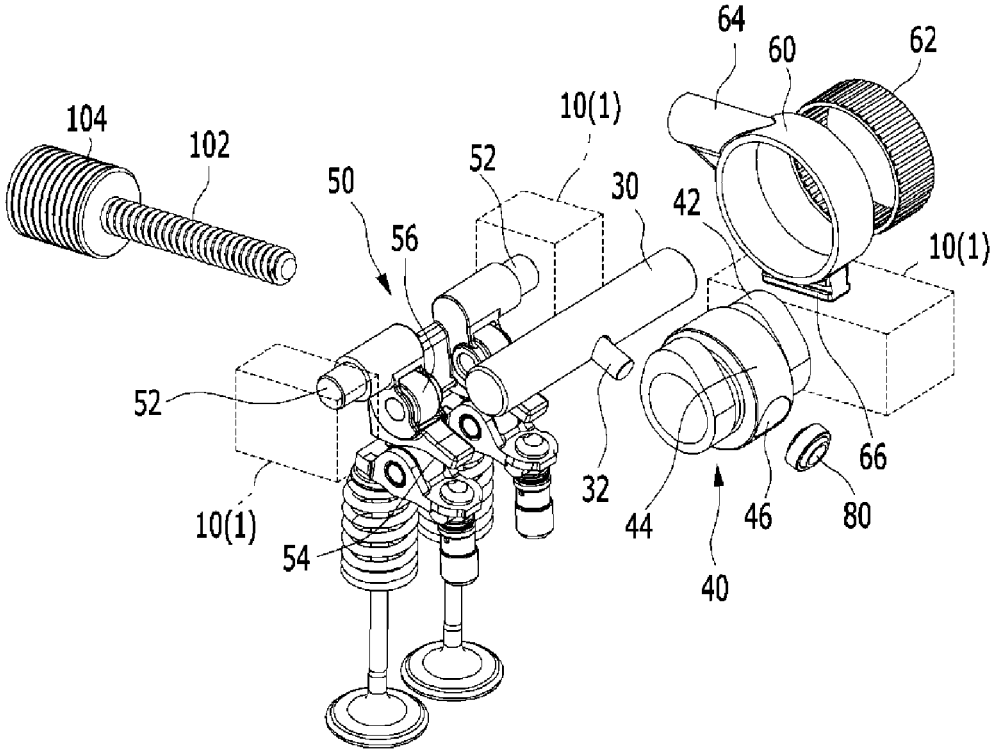
FIG. 2 is an exploded perspective view of a continuous variable valve lift apparatus.
Figure 3:
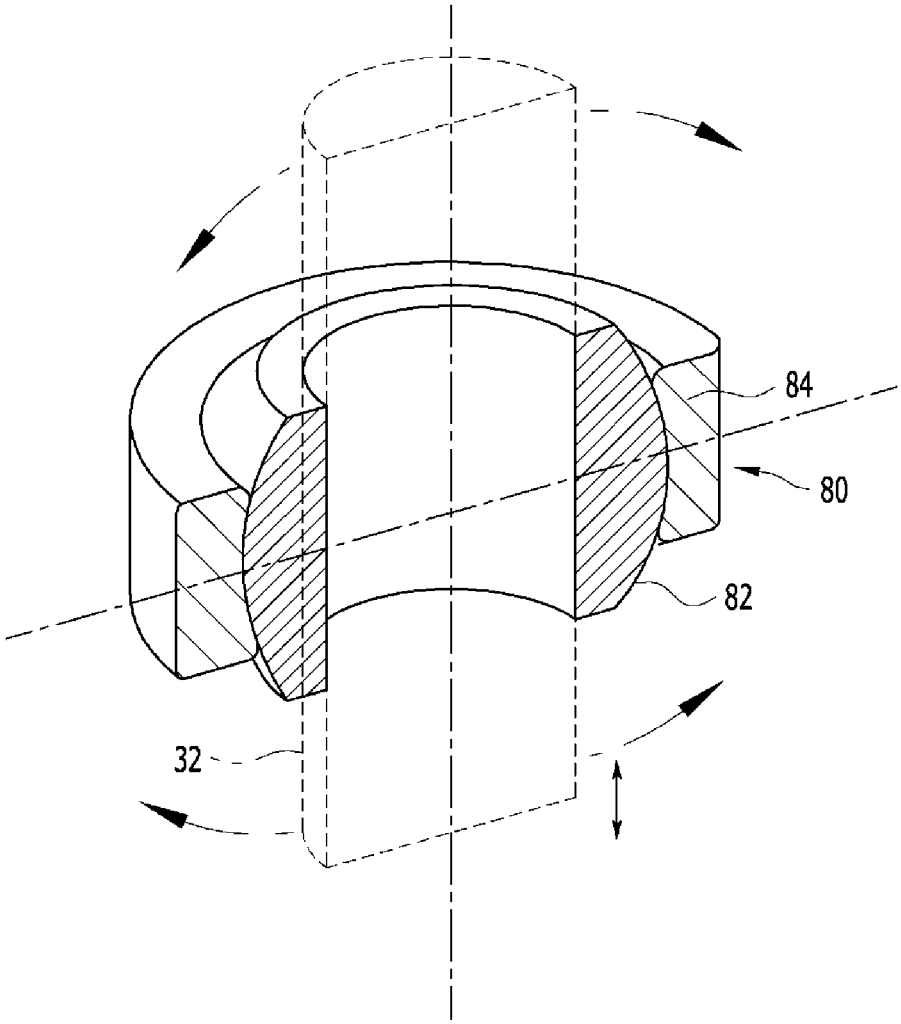
FIG. 3 is a cross-sectional view of a spiral bearing provided to a continuous variable valve lift apparatus.

Referring to FIG. 1 to FIG. 3, an engine 1 according to an embodiment of the present disclosure includes a cylinder head 10 and a continuous variable valve lift apparatus mounted to the cylinder head 10.

A continuously variable valve lift apparatus according to an embodiment of the present disclosure includes a camshaft 30, a cam portion 40 on which a cam 42 is formed and to which the camshaft 30 is inserted, a slider housing 60 to which the cam portion 40 is rotatably inserted and a position of which is movable, a control portion 100 selectively changing the position of the slider housing 60, an output portion 50 rotatable around a pivot shaft 52, the output portion 50 having a valve shoe 54 formed thereto, and a valve unit 200 configured to be driven by the valve shoe 54.

The pivot shaft 52 is rotatably mounted to the cylinder head 10, and the cylinder head 10 includes a cam carrier.

A rail 66 is formed on the slider housing 60 and the slider housing 60 is movable on the cylinder head 10.

As shown in FIG. 1 and FIG. 2, the cam 42 may be formed on both sides of the cam portion 40, the output portion 50 may be configured as a pair to contact each of cams 42 and the valve unit 200 is configured as a pair and each valve unit 200 may be configured as a pair and two valve unit 200 may contact the output portion 50 respectively so as to be driven.

A connecting pin 32 is connected to the camshaft 30 and a spiral bearing 80 to which the connecting pin 32 is inserted is mounted to the cam portion 40.

The spiral bearing 80 may include an outer wheel 84 connected to driving hole 46 of the cam portion 40 and an inner wheel 82 rotatably connected to the outer wheel 84. The connecting pin 32 is slidable in the inner wheel 82.

A bearing 62 is interposed between the cam portion 40 and a driving surface 44 of the slider housing 60. Thus, rotation of the cam portion 40 may be easily performed. In the drawings, the bearing 62 is depicted as a needle bearing, however it is not limited thereto. On the contrary, various bearings such as a ball bearing, a roller bearing and so on may be applied thereto.

The output portion 50 includes an output roller 56 contacting the cam 42 and changes a rotary motion of the cam 42 to a swing motion around the pivot shaft 52.

A ball screw housing 64 is formed on the slider housing 60, the control portion 100 includes a ball screw 102 engaged with the ball screw housing 64, and a control motor 104 drives the ball screw 102. The position of the slider housing 60 may be changed according to the operation of the control motor 104.

The valve unit 200 may be a swing arm including a swing arm roller 202 contacting the valve shoe 54 and a valve 204.

Figure 4:
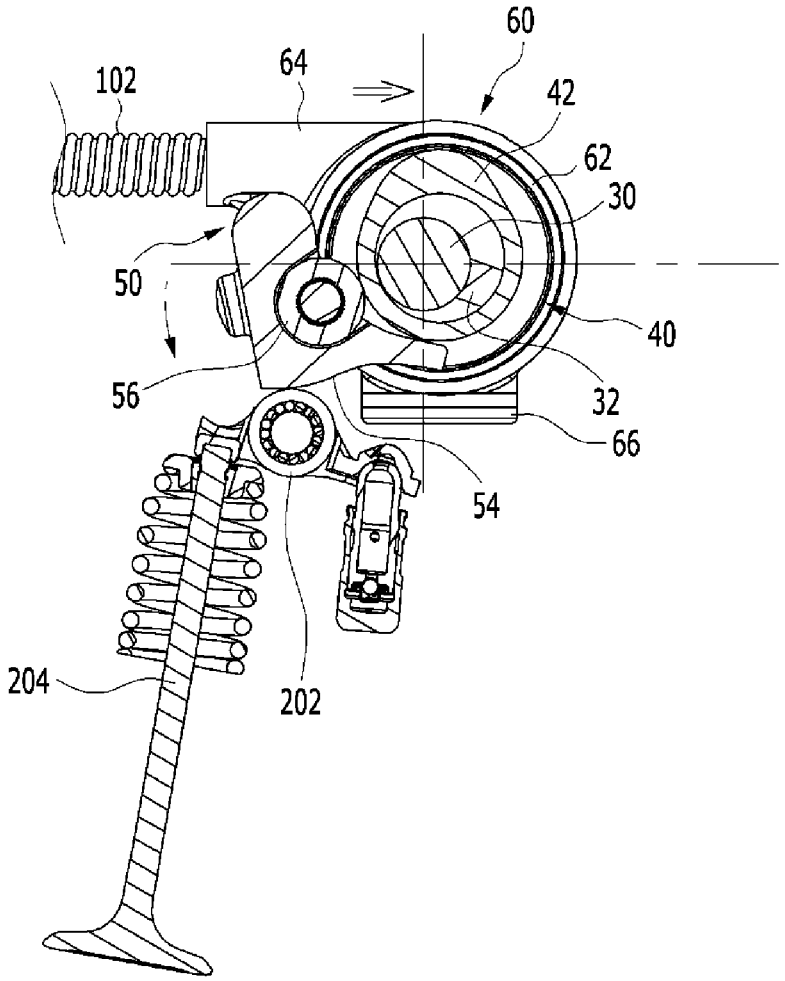
FIG. 4 and FIG. 5 are drawings showing operations in a low lift mode of a continuous variable valve lift apparatus.
Figure 5:
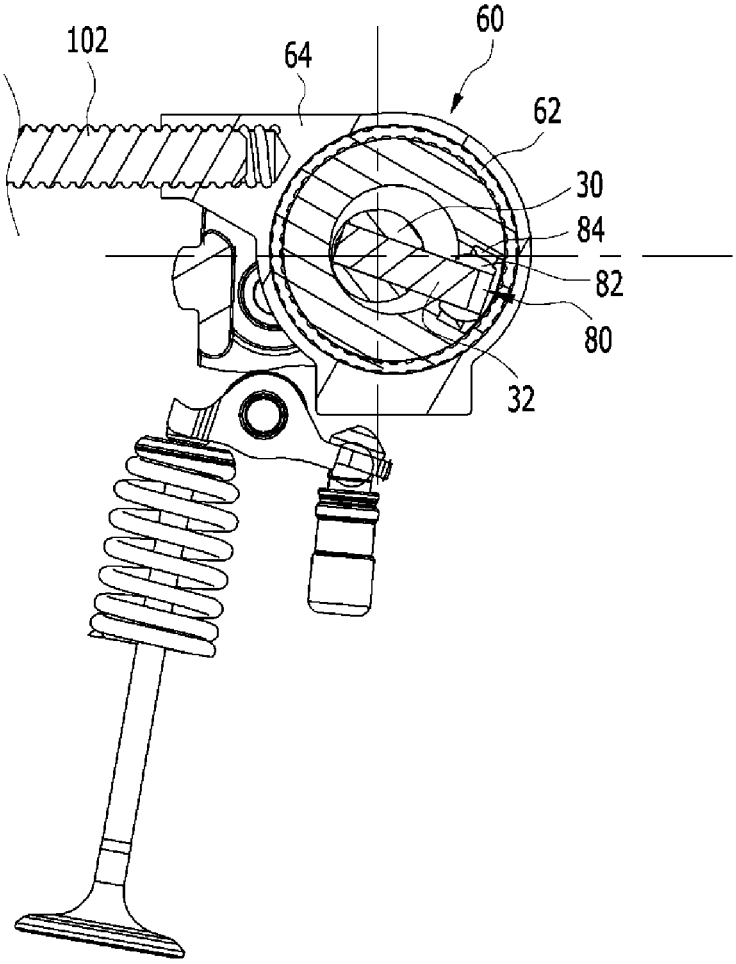
Figure 6:
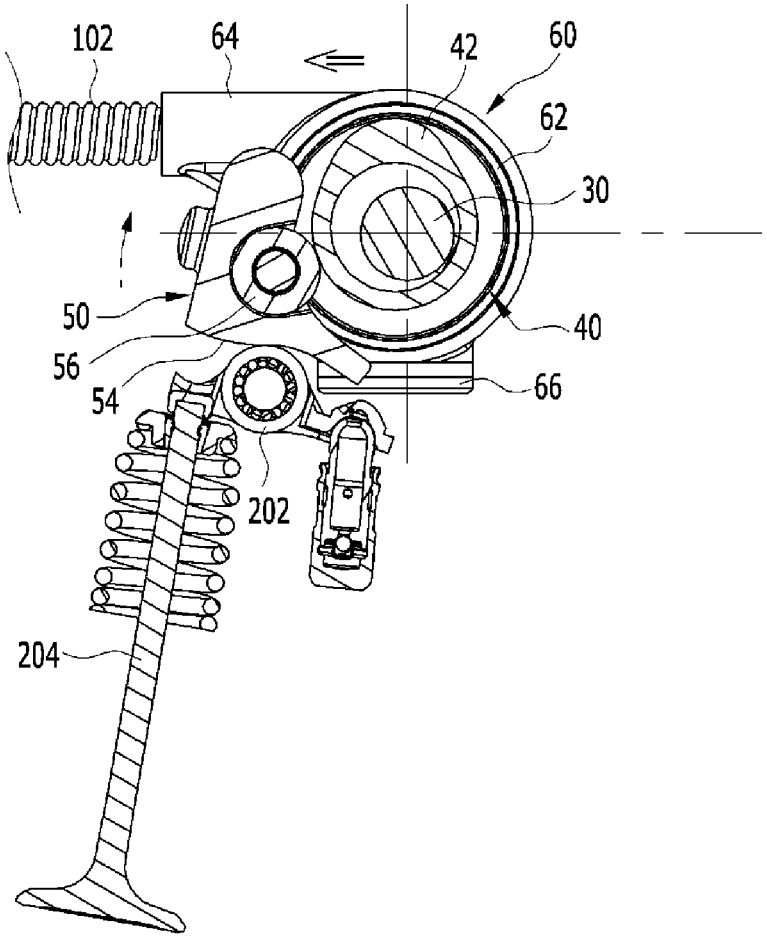
FIG. 6 and FIG. 7 are drawings showing operations in a high lift mode of a continuous variable valve lift apparatus.
Figure 7:
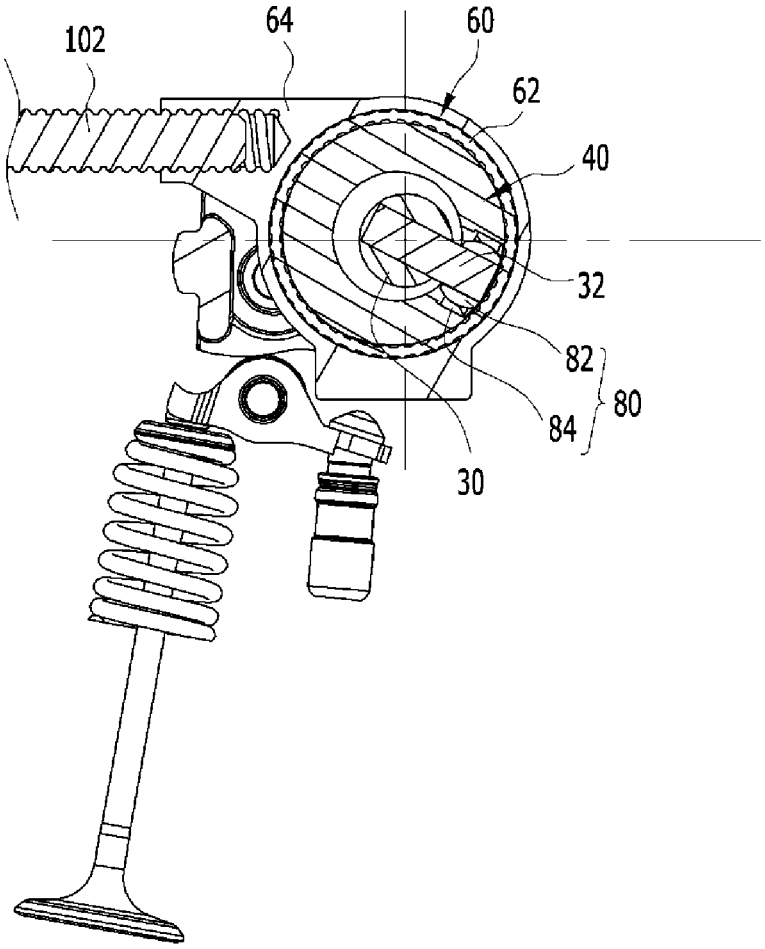

FIG. 4 and FIG. 5 are drawings showing operations in a low lift mode of a continuous variable valve lift apparatus according to an embodiment of the present disclosure, and FIG. 6 and FIG. 7 are drawings showing operations in a high lift mode of a continuous variable valve lift apparatus.

Figure 8:
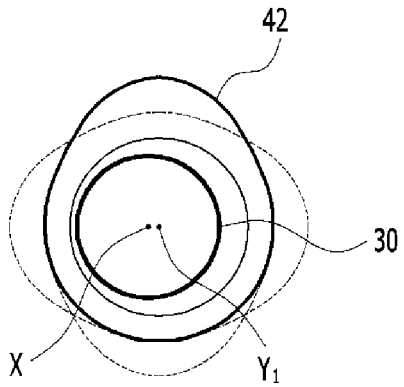
FIG. 8 and FIG. 9 are drawings showing mechanical motions of cams of a continuous variable valve lift apparatus.
Figure 9:
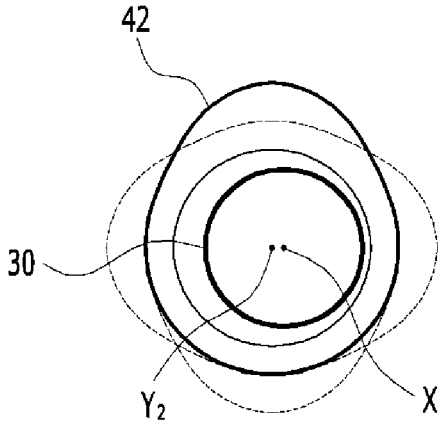
Figure 10:
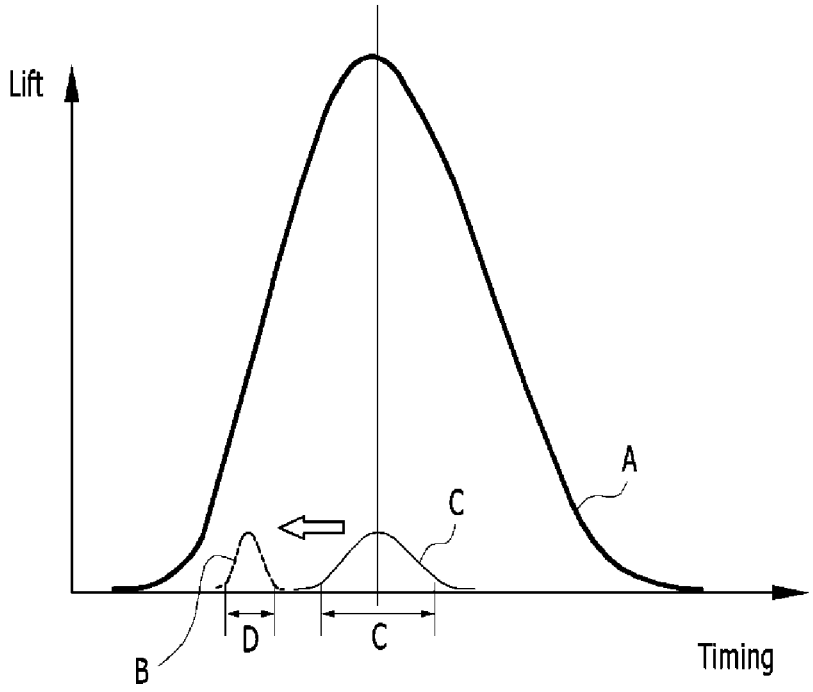
FIG. 10 is a graph of a valve profile of a continuous variable valve lift apparatus.

FIG. 8 and FIG. 9 are drawings showing mechanical motions of cams of a continuous variable valve lift apparatus, and FIG. 10 is a graph of a valve profile of a continuous variable valve lift apparatus.

Referring to FIG. 1 to FIG. 10, operations of the continuously variable valve lift apparatus according to an embodiment of the present disclosure will be described.

According to engine operation states, the ECU transmits control signals to the motor 104 of the control portion 100 to change the relative position of the slider housing 60.

As shown in FIG. 4 and FIG. 5, for example, in low lift mode the slider housing 60 moves to the right direction according to the operation of the control portion 100.

Since the camshaft 30 is connected to the connecting pin 32 and the connecting pin 32 is connected to the spiral bearing 80, thus the rotation of the camshaft 30 is transmitted to the cam portion 40 through the connecting pin 32 and the spiral bearing 80.

Since the slider housing 60 moves to right direction, the output portion 50 relatively rotates in a counterclockwise direction around the pivot shaft 52.

Since the output portion 50 relatively rotates in a counterclockwise direction around the pivot shaft 52, a contacting position of the valve shoe 54 and the swing arm roller 202 as well as a contacting position of the cam 42 and the output roller 56 are changed.

That is, as shown in FIG. 8, while a rotation center X of the cam shaft 30 is constant, however a rotation center of the cam 42 is changed to the right direction at Y1. Thus the contacting position of the cam 42 and the output roller 56 and the contacting position of the valve shoe 54 and the swing arm roller 202 are changed.

As shown in FIG. 4 and FIG. 5, for example, in high lift mode the slider housing 60 moves to the right direction according to the operation of the control portion 100.

As shown in FIG. 6 and FIG. 7, for example, in high lift mode the slider housing 60 moves to the left direction according to the operation of the control portion 100.

Since the slider housing 60 moves to left direction, the output portion 50 relatively rotates in a clockwise direction around the pivot shaft 52.

Since the output portion 50 relatively rotates in a clockwise direction around the pivot shaft 52, the contacting position of the valve shoe 54 and the swing arm roller 202 as well as the contacting position of the cam 42 and the output roller 56 are changed.

That is, as shown in FIG. 9, while the rotation center X of the cam shaft 30 is constant, however the rotation center of the cam 42 is changed to the right direction at Y2. Thus the contacting position of the cam 42 and the output roller 56 and the contacting position of the valve shoe 54 and the swing arm roller 202 are changed.

As shown in FIG. 10, a high lift profile A or a low lift profile B of the valve 204 may be performed according to the relative rotation center of the cam 42 with respect to the camshaft 30, relative positions of the camshaft 30 and the output roller 56 and the contacting position of the valve shoe 54 and the swing arm roller 202.

While only the high lift profile A and the low lift profile are shown in FIG. 10, however it is not limited thereto. The relative position of the slider housing 60 may perform various valve profile.

As shown in FIG. 10, comparing to a valve duration C of a general continuously variable valve lift apparatus in the low lift mode, a valve duration D of the continuously variable valve lift apparatus may be reduced. And valve closing time may be advanced comparing to valve closing time of the general continuously variable valve lift apparatus in the low lift mode due to contacting position change of the cam 42 and the output roller 56.

So that the continuous variable valve lift apparatus according to an embodiment of the present disclosure may reduce pumping loss and enhance fuel economy.

Figure 11:
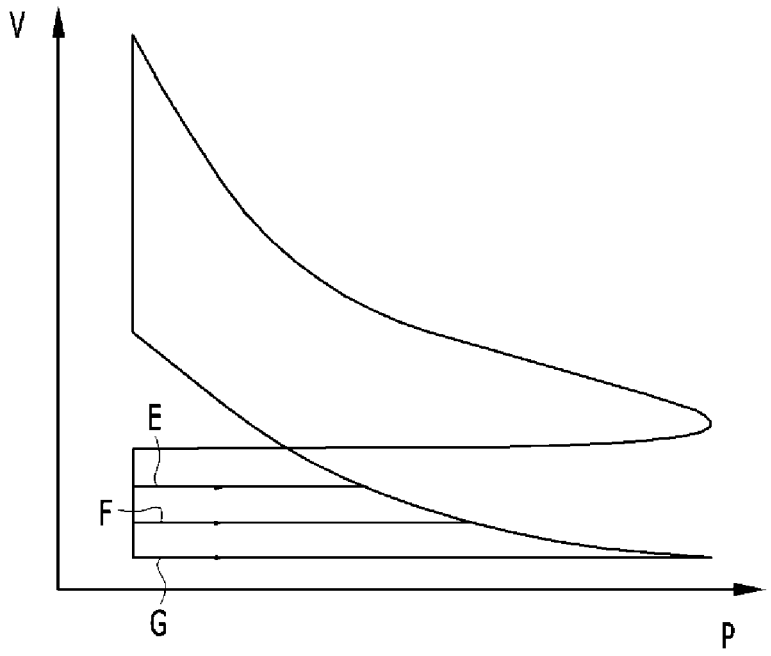
FIG. 11 is a graph of pressure volume diagram of an engine.

FIG. 11 is a graph of pressure volume diagram of an engine.

As shown in FIG. 11, an engine provided with a continuous variable valve lift apparatus may reduce pumping loss F comparing to pumping loss E of an engine without a continuous variable valve lift apparatus.

However, the continuously variable valve lift apparatus may reduce valve duration and advance valve closing time so that may reduce pumping loss G and may enhance fuel economy.

The continuous variable valve lift apparatus according to the present disclosure may be reduced in size and thus the entire height of a valve train may be reduced.

Since the continuous variable valve lift apparatus may be applied to an existing engine without excessive modification, thus productivity may be enhance and production cost may be reduced.

While this present disclosure has been described in connection with what is presently considered to be practical embodiments, it is to be understood that the present disclosure is not limited to the disclosed embodiments. On the contrary, it is intended to cover various modifications and equivalent arrangements included within the spirit and scope of the appended claims.

What is claimed is:

1. A continuously variable valve lift apparatus comprising:

a camshaft;

a cam portion on which a cam is formed, the camshaft being inserted into the cam portion;

a slider housing to which the cam portion is rotatably inserted, a position of the slider housing and a rotation center of the cam each being movable with respect to the camshaft;

a control portion configured to selectively change the position of the slider housing;

an output portion configured to rotate around a pivot shaft and having a valve shoe formed thereto; and a valve unit configured to be driven by the valve shoe.

2. The continuously variable valve lift apparatus of claim 1, further comprising:

a connecting pin connected with the camshaft; and a spiral bearing mounted to the cam portion, the connecting pin inserted in the spiral bearing.

3. The continuously variable valve lift apparatus of claim 1, further comprising a bearing interposed between the cam portion and the slider housing.

4. The continuously variable valve lift apparatus of claim 1, wherein the output portion comprises an output roller configured to contact the cam.

5. The continuously variable valve lift apparatus of claim 1, wherein a ball screw housing is formed on the slider housing, and wherein the control portion comprises:

a ball screw configured to engage with the ball screw housing; and a control motor configured to drive the ball screw.

6. The continuously variable valve lift apparatus of claim 1, wherein the valve unit comprises:

a swing arm roller configured to contact the valve shoe; and a valve.

7. The continuously variable valve lift apparatus of claim 1, wherein a rail is formed on the slider housing and configured to guide a movement of the slider housing.

8. The continuously variable valve lift apparatus of claim 1, wherein:

the cam is formed on both sides of the cam portion;

the output portion is configured as a pair to contact each of the cams of the cam portion; and the valve unit is a pair, each valve unit comprising a swing arm roller configured to contact each valve shoe of each output portion and a valve.

9. An engine comprising:

a camshaft;

a cam portion of which a cam is formed thereto and the camshaft is inserted into therein;

a slider housing of which the cam portion is rotatably inserted therein, the slider housing configured to move on a cylinder head;

a control portion configured to selectively change a position of the slider housing relative to the camshaft;

an output portion configured to rotate around a pivot shaft connected to the cylinder head and having a valve shoe formed thereto; and a valve unit configured to be driven by the valve shoe.

10. The engine of claim 9, further comprising:

a connecting pin connected with the camshaft; and a spiral bearing mounted to the cam portion and of which the connecting pin is inserted therein.

11. The engine of claim 9, further comprising a bearing interposed between the cam portion and the slider housing.

12. The engine of claim 9, wherein the output portion comprises an output roller configured to contact the cam.

13. The engine of claim 9, wherein a ball screw housing is formed to the slider housing, and wherein the control portion comprises:

a ball screw configured to engage with the ball screw housing; and a control motor configured to drive the ball screw.

14. The engine of claim 9, wherein the valve unit comprises:

a swing arm roller configured to contact the valve shoe; and a valve.

15. The engine of claim 9, wherein a rail is formed on the slider housing and configured to guide a movement of the slider housing.

16. The engine of claim 9, wherein the cam is formed on both sides of the cam portion, the output portion is configured as a pair to contact to each cam, and the valve unit is a pair, wherein each valve unit comprises a swing arm roller configured to contact each valve shoe of each output portion and a valve.

* * * * *